US008390527B2

(12) United States Patent
Conrad

(10) Patent No.: US 8,390,527 B2
(45) Date of Patent: Mar. 5, 2013

(54) PORTABLE SATELLITE DISH ANTENNA SYSTEM

(75) Inventor: Timothy John Conrad, Mt. Pleasant, IA (US)

(73) Assignee: Winegard Company, Burlington, IA (US)

( * ) Notice: Subject to any disclaimer, the term of this patent is extended or adjusted under 35 U.S.C. 154(b) by 327 days.

(21) Appl. No.: 12/906,714

(22) Filed: Oct. 18, 2010

(65) Prior Publication Data

US 2011/0090132 A1 Apr. 21, 2011

Related U.S. Application Data

(60) Provisional application No. 61/253,577, filed on Oct. 21, 2009.

(51) Int. Cl.
*H01Q 1/08* (2006.01)

(52) U.S. Cl. ..... 343/880; 343/881; 343/882

(58) Field of Classification Search ..... 343/880, 343/881, 882, 878, 702
See application file for complete search history.

(56) References Cited

U.S. PATENT DOCUMENTS

| | | | | |
|---|---|---|---|---|
| 3,646,564 | A * | 2/1972 | Drislane | 343/766 |
| 5,532,710 | A | 7/1996 | Rodeffer | |
| 5,646,638 | A | 7/1997 | Winegard et al. | |
| 5,760,751 | A | 6/1998 | Gipson | |
| 6,573,871 | B2 * | 6/2003 | Drews et al. | 343/713 |
| 6,682,029 | B1 | 1/2004 | Dierkes | |
| 6,734,830 | B1 | 5/2004 | Bickham | |
| 6,798,387 | B2 | 9/2004 | Cockell et al. | |
| 7,218,289 | B2 | 5/2007 | Trajkovic et al. | |
| 7,397,435 | B2 | 7/2008 | McEwan | |
| 7,598,916 | B2 * | 10/2009 | Inbal et al. | 343/718 |
| 7,679,573 | B2 * | 3/2010 | Shuster et al. | 343/766 |
| 2004/0160375 | A1 * | 8/2004 | King | 343/757 |
| 2007/0279308 | A1 | 12/2007 | Olsen et al. | |

OTHER PUBLICATIONS

Winegard 46 cm Portable Satellite System Models RD-9046/RD-9146 brochure, Feb. 2008, 4 pages, Winegard Company, USA.

* cited by examiner

*Primary Examiner* — Hoanganh Le
(74) *Attorney, Agent, or Firm* — W. Scott Carson

(57) ABSTRACT

A lightweight, portable satellite dish antenna system having base and lid portions which can be configured relative to each other in carrying and deployed positions. The base and lid portions are substantially the same size and shape and have respective interior and exterior sides with the satellite dish antenna of the system pivotally mounted to the interior side of the lid portion. In the carrying position, the satellite dish antenna is retracted to align with the interior side of the lid portion and the lid and base portions are secured together with the interior sides thereof facing and abutting each other. In the deployed or operating position, the lid portion is inverted and placed atop the base portion with the exterior side of the lid portion and the interior side of the base portion facing and abutting one another on mating bearing surfaces extending about a central, vertical axis.

22 Claims, 19 Drawing Sheets

PORTABLE SATELLITE DISH ANTENNA SYSTEM

RELATED APPLICATIONS

This application claims the benefit of U.S. Provisional Patent Application Ser. No. 61/253,577 filed Oct. 21, 2009, which is incorporated herein by reference.

BACKGROUND OF THE INVENTION

1. Field of the Invention

This invention relates to the field of satellite dish antennas and more particularly to ones that are compact and portable.

2. Discussion of the Background

Satellite dish antenna systems that are compact and portable are very popular and enable the operators to manually carry and set up their systems virtually anywhere. Most such systems have foldable components that can be extended in use and retracted for carrying and storage. However, such current designs tend to be fairly elaborate with multiple moving parts that are both complicated to manufacture and use.

With this and other problems in mind, the present invention was developed. In it, the components of the system were specifically designed to perform multiple functions relating to both the operation and portability of the antenna system thereby reducing the number and complexity of the various parts and reducing the overall weight and size of the portable system.

SUMMARY OF THE INVENTION

This invention involves a lightweight, portable satellite dish antenna system. The system has base and lid portions which can be configured relative to each other in carrying and deployed positions. The base and lid portions are substantially the same size and shape and have respective interior and exterior sides. The satellite dish antenna of the system is pivotally mounted to the interior side of the lid portion.

In the carrying position, the satellite dish antenna is retracted to align with the interior side of the lid portion and the lid and base portions are secured together with the interior sides thereof facing and abutting each other. In the deployed or operating position, the lid portion is inverted and placed atop the base portion with the exterior side of the lid portion and the interior side of the base portion facing and abutting one another. The exterior side of the lid portion and the interior side of the base portion have mating bearing surfaces extending about a central, vertical axis. In use, the satellite dish antenna can be elevated as desired with the lid portion inverted atop the base portion. The lid portion can subsequently be rotated relative to the base portion to the desired azimuth position about the vertical axis with the mating bearing surfaces in contact with each other. The lid and base portions can thereafter be drawn tightly together by a central, threaded locking bolt to fix the lid portion in the operating position on the base portion.

DETAILED DESCRIPTION OF THE INVENTION

Figure 2:
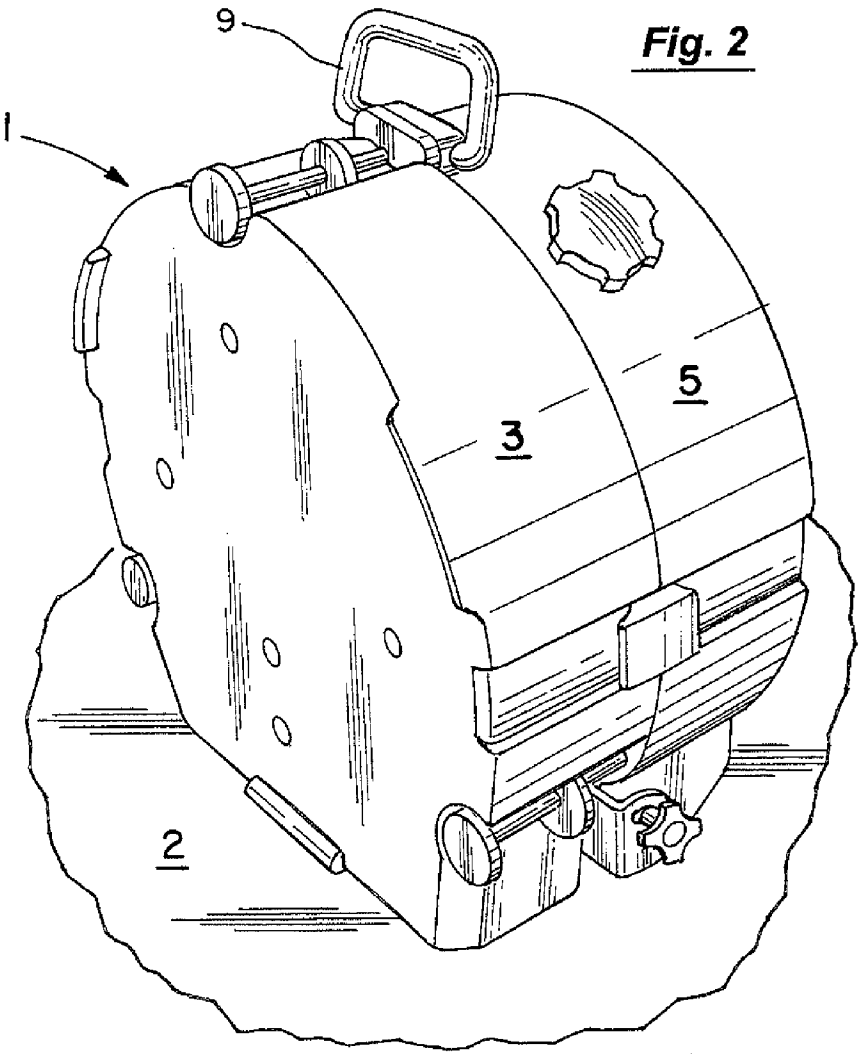
FIGS. 1-10 sequentially show how the various components of the portable satellite dish antenna system of the present invention can be manipulated to convert the system from its compact, carrying configuration of FIG. 1 to a fully deployed configuration supported either on a flat surface 2 as in FIG. 7 or on a tripod arrangement such as in FIGS. 8-10.
Figure 1:
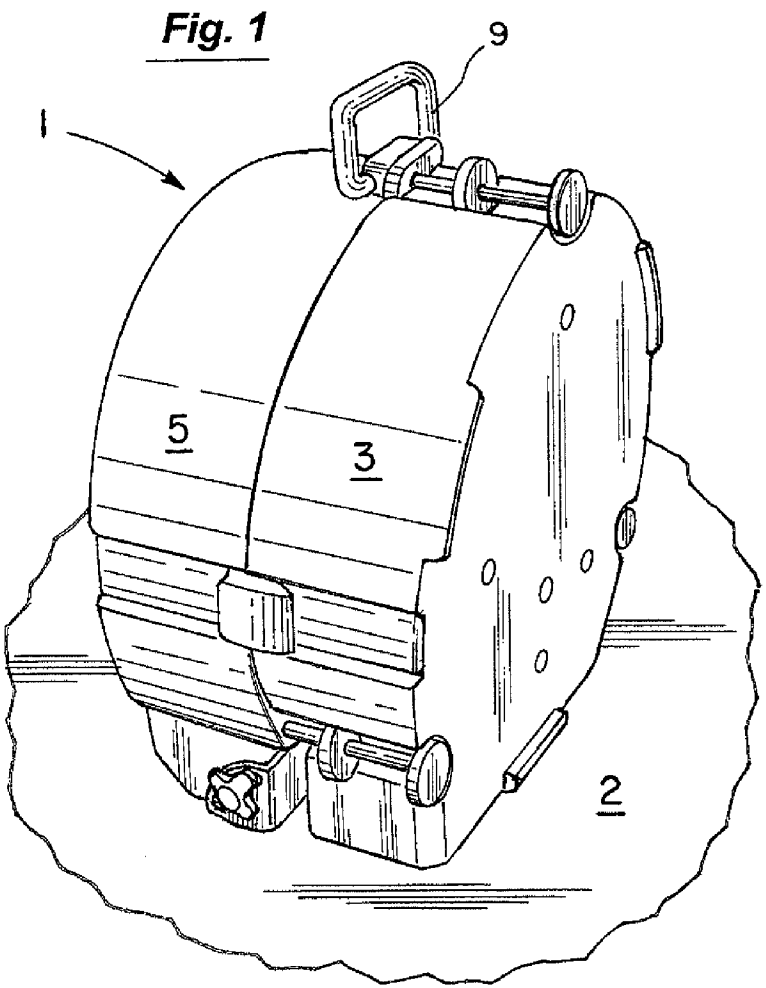
Figure 8:
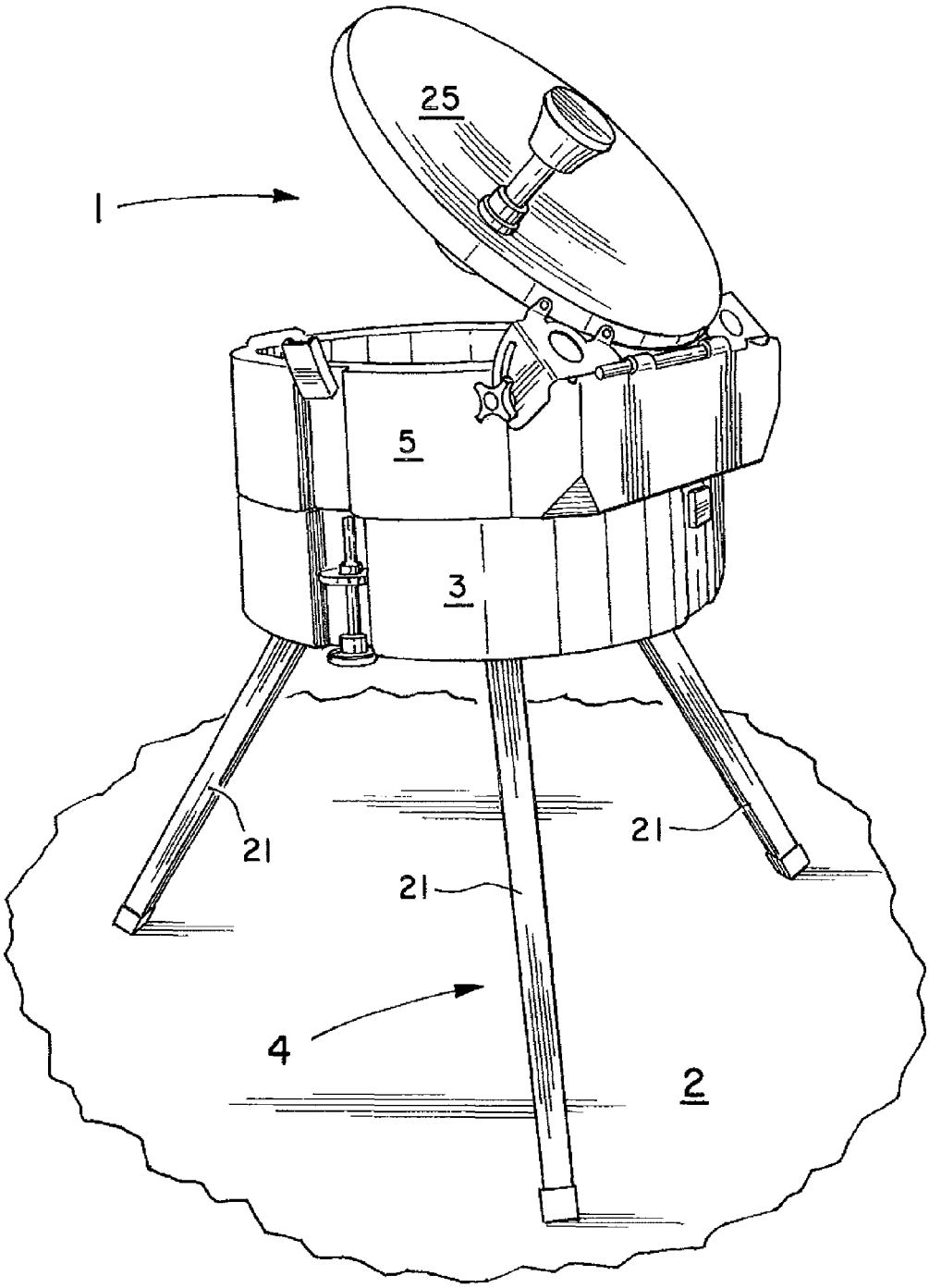
Figure 9:
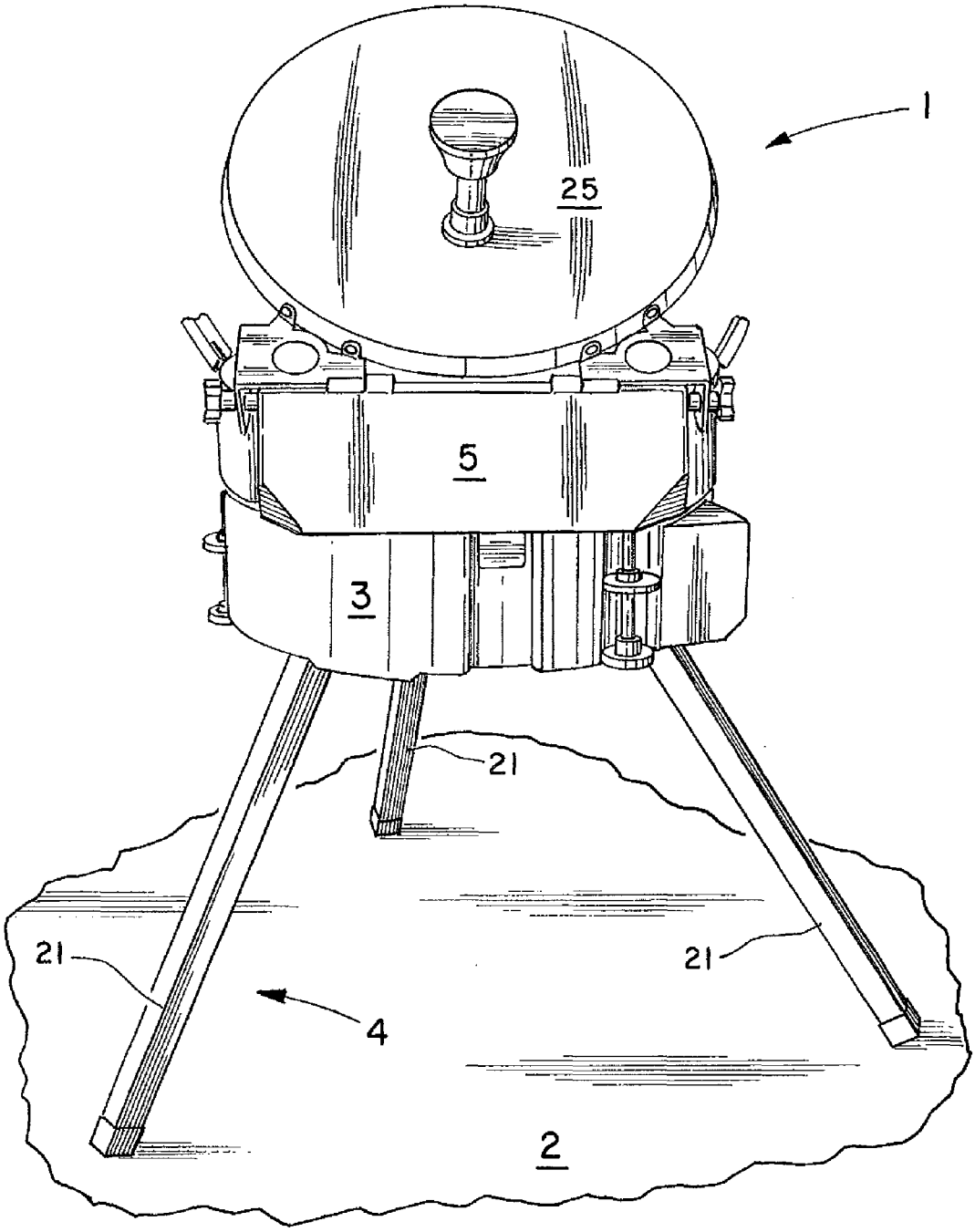
Figure 10:
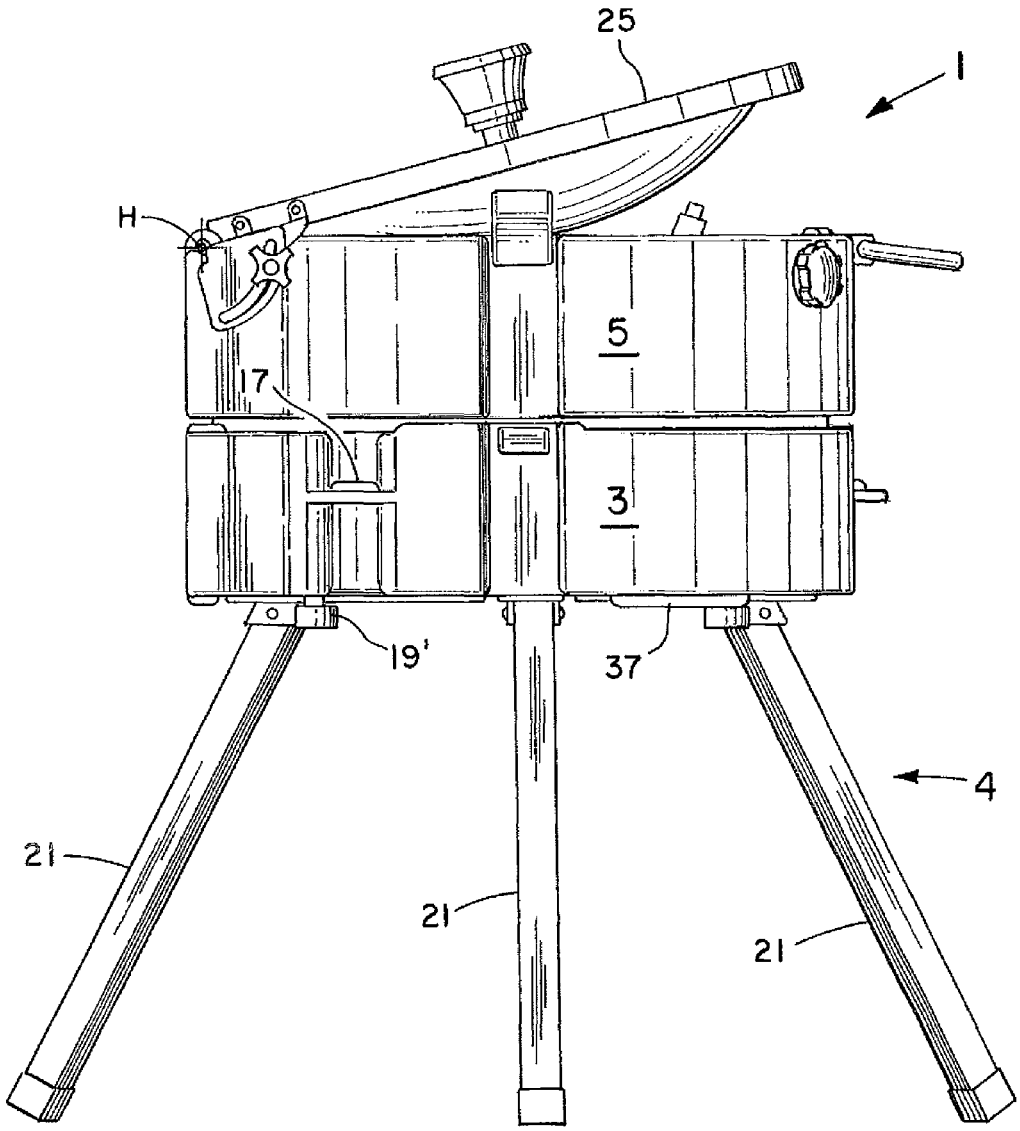
Figure 11:
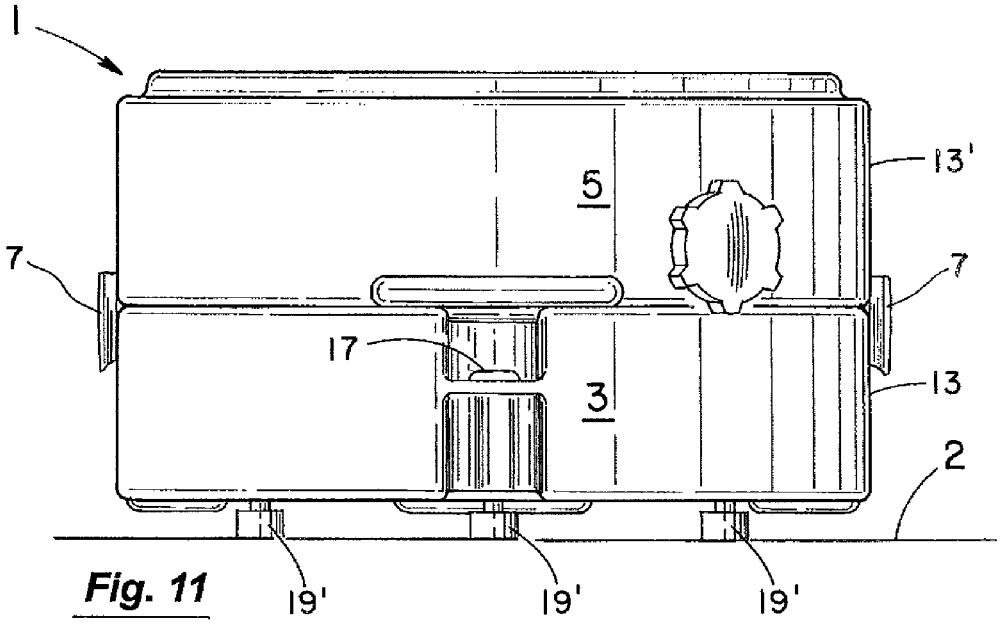
FIG. 11 illustrates the lid and base portions of the system secured to each other and the system placed with its base portion on a flat surface.
Figure 12:
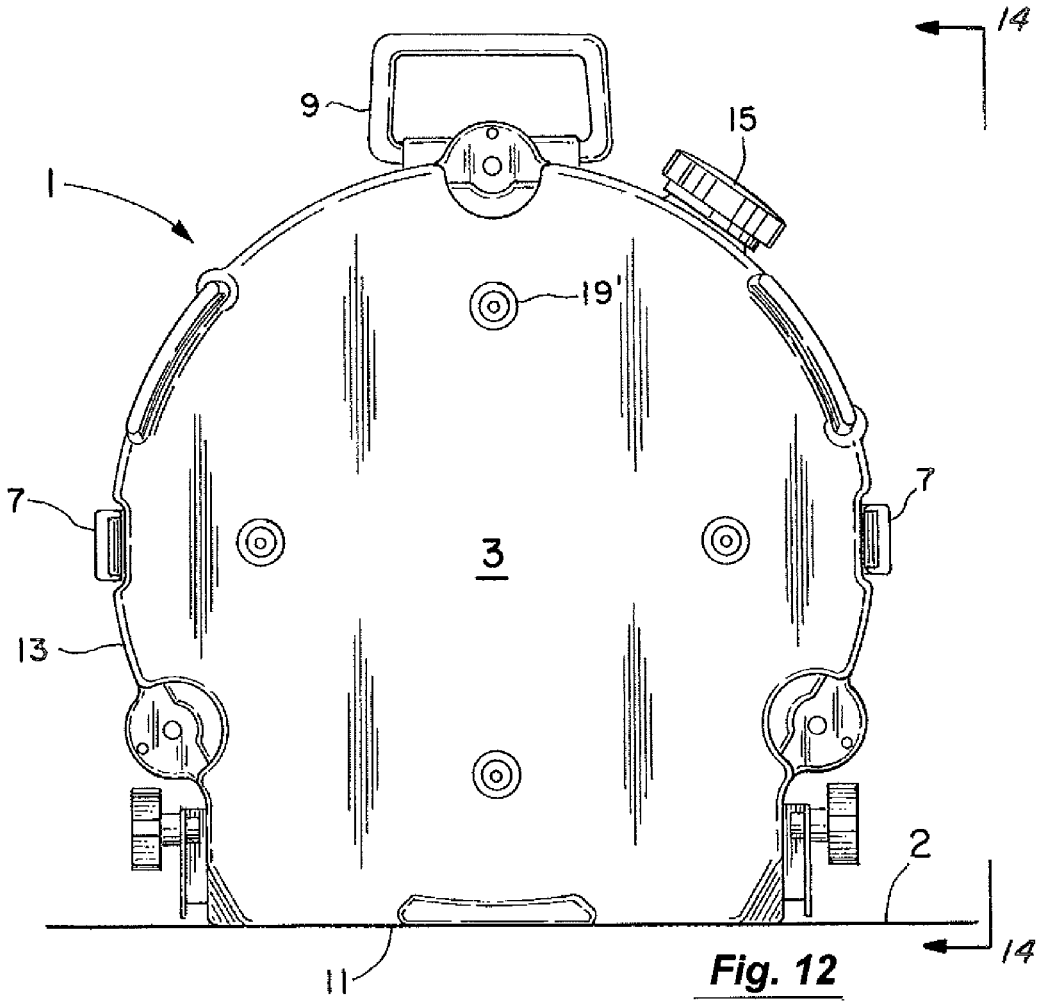
FIG. 12 is a view of the secured system in an upright position.
Figure 14:
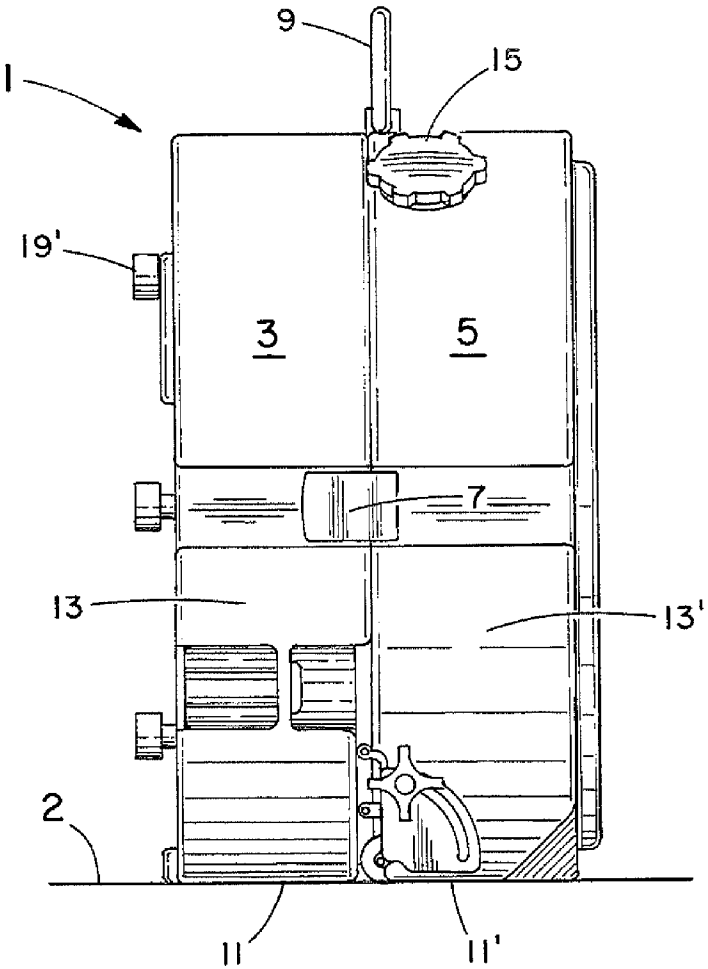
FIG. 14 is a side view taken along line 14-14 of FIG. 12.
Figure 13:
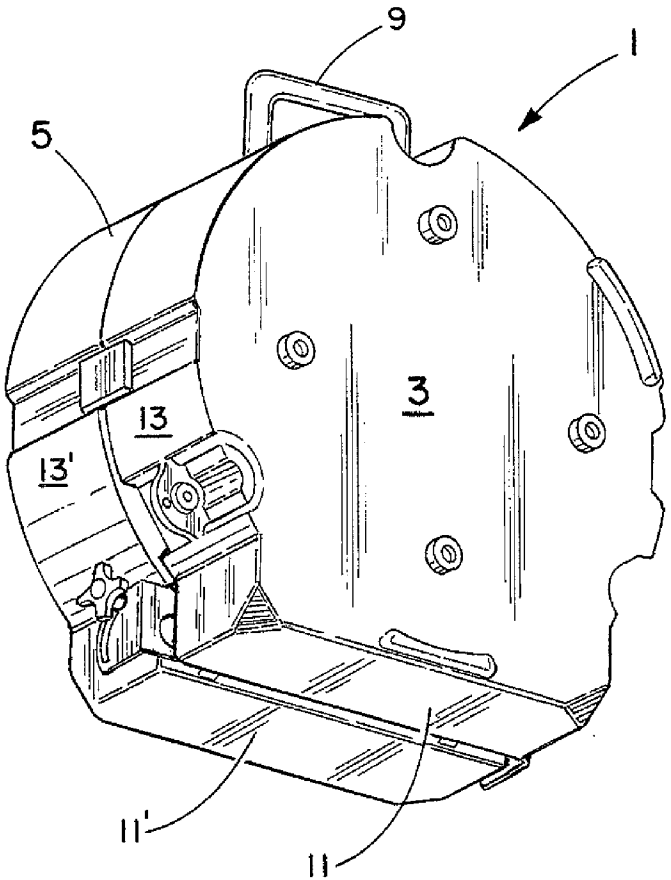
FIG. 13 is a perspective view of the secured system.

FIGS. 1-10 sequentially show how the various components of the portable satellite dish antenna system 1 of the present invention can be manipulated to convert the system 1 from its compact, carrying configuration of FIG. 1 to a fully deployed configuration supported either on a flat surface 2 (FIG. 7) or on a tripod arrangement such as 4 (FIGS. 8-10). The system 1 in this regard has a base portion 3 (see FIG. 11) and a lid portion 5. In the carrying configuration of FIGS. 1 and 12, the base and lid portions 3,5 are securely latched together by the latching mechanisms 7 (FIGS. 11-12) wherein the system 1 can be manually carried by the handle 9 (FIG. 12). Flat sections 11,11' are provided on the peripheral surfaces 13,13' of the base and lid portions 3,5 (FIGS. 12-14). In this manner, the system 1 can be easily and quickly set down on any level surface such as 2 when not in use. The flat sections 11,11' as shown are aligned adjacent one another substantially in a common plane when the base and lid portions 3,5 are secured to each other. Additionally, the handle 9 as illustrated in FIGS. 12 and 14 is positioned on at least one of the peripheral surfaces (e.g., 13') substantially opposite the flat sections 11,11'.

Figure 4:
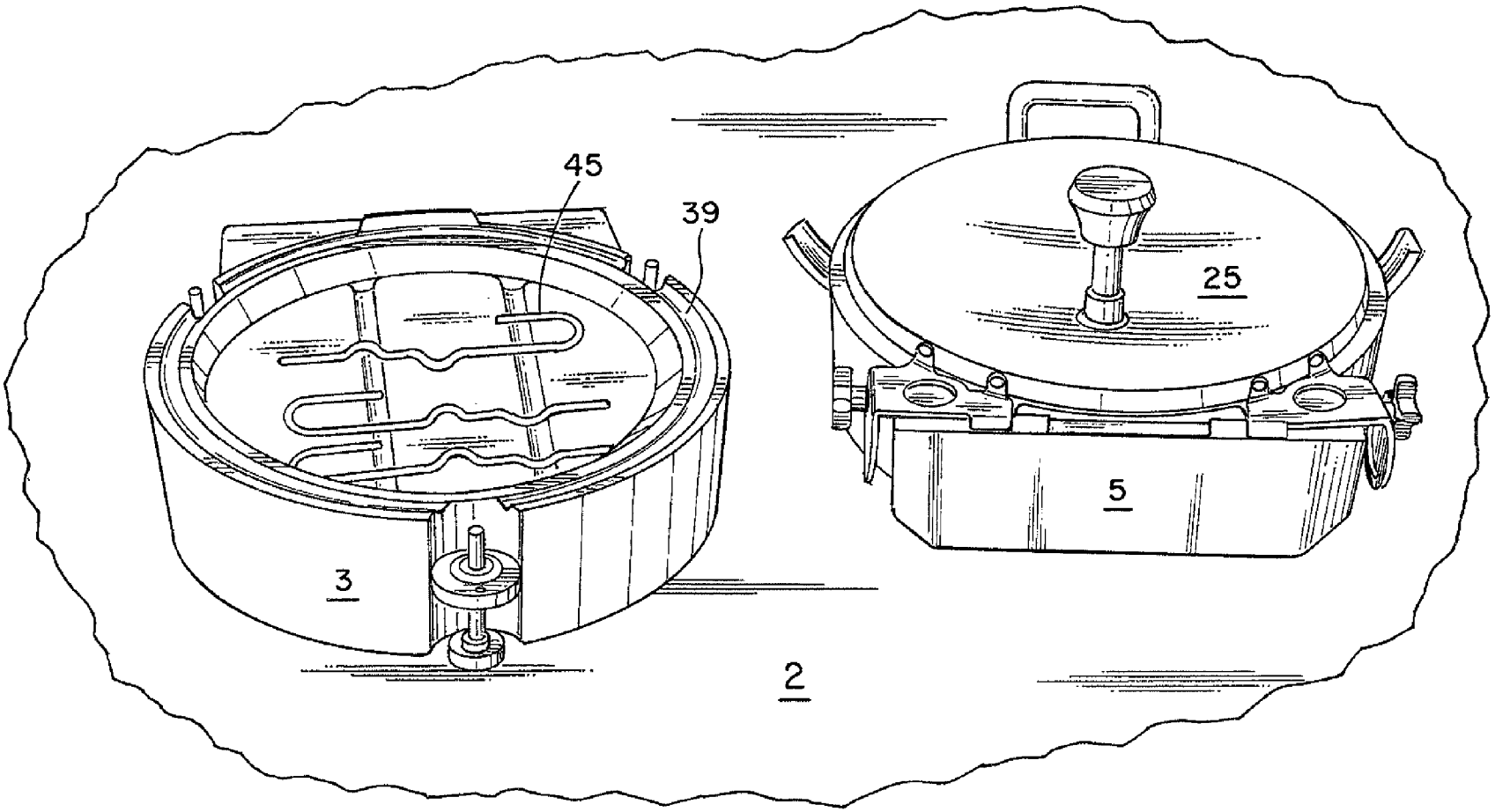
Figure 5:
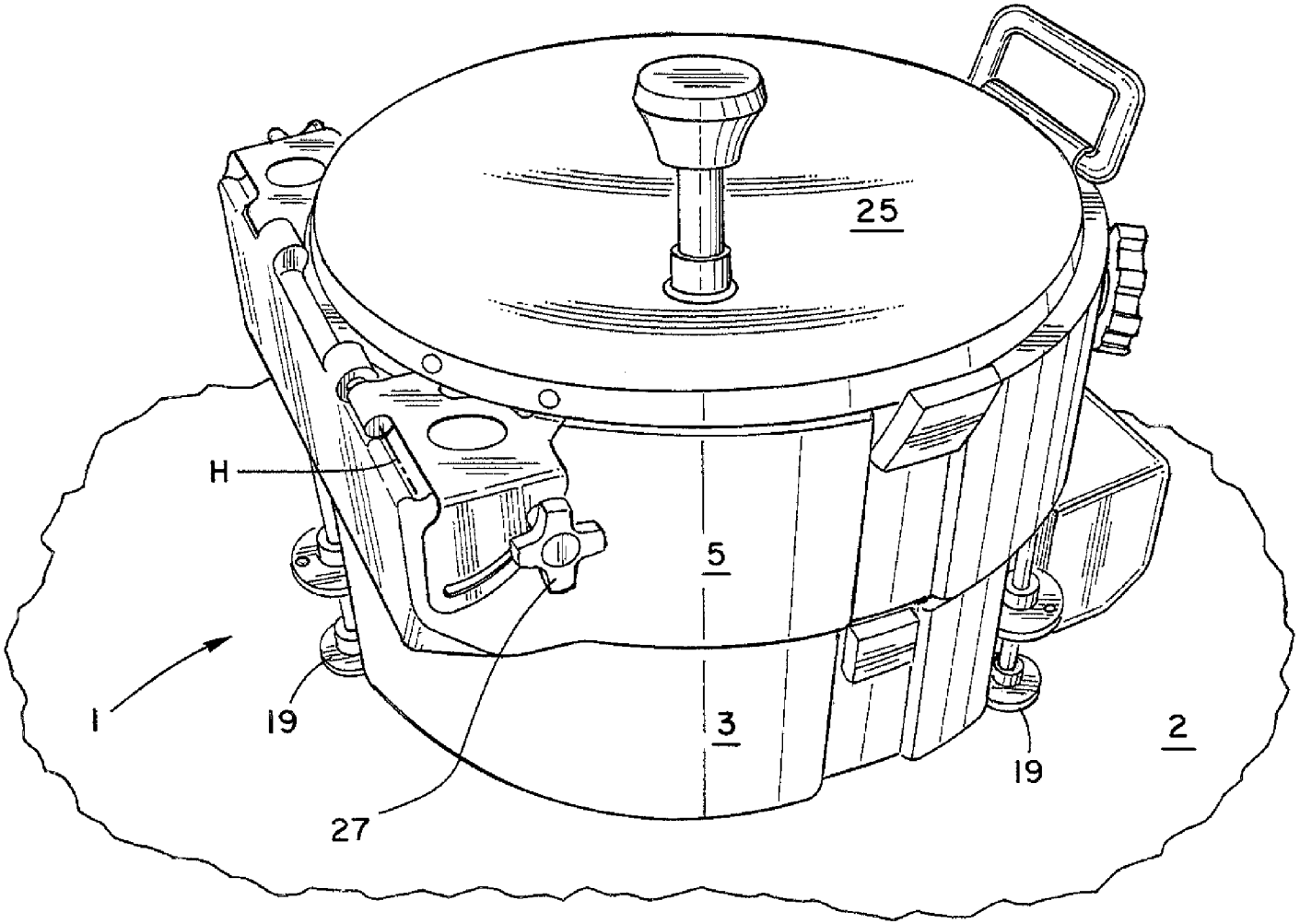
Figure 6:
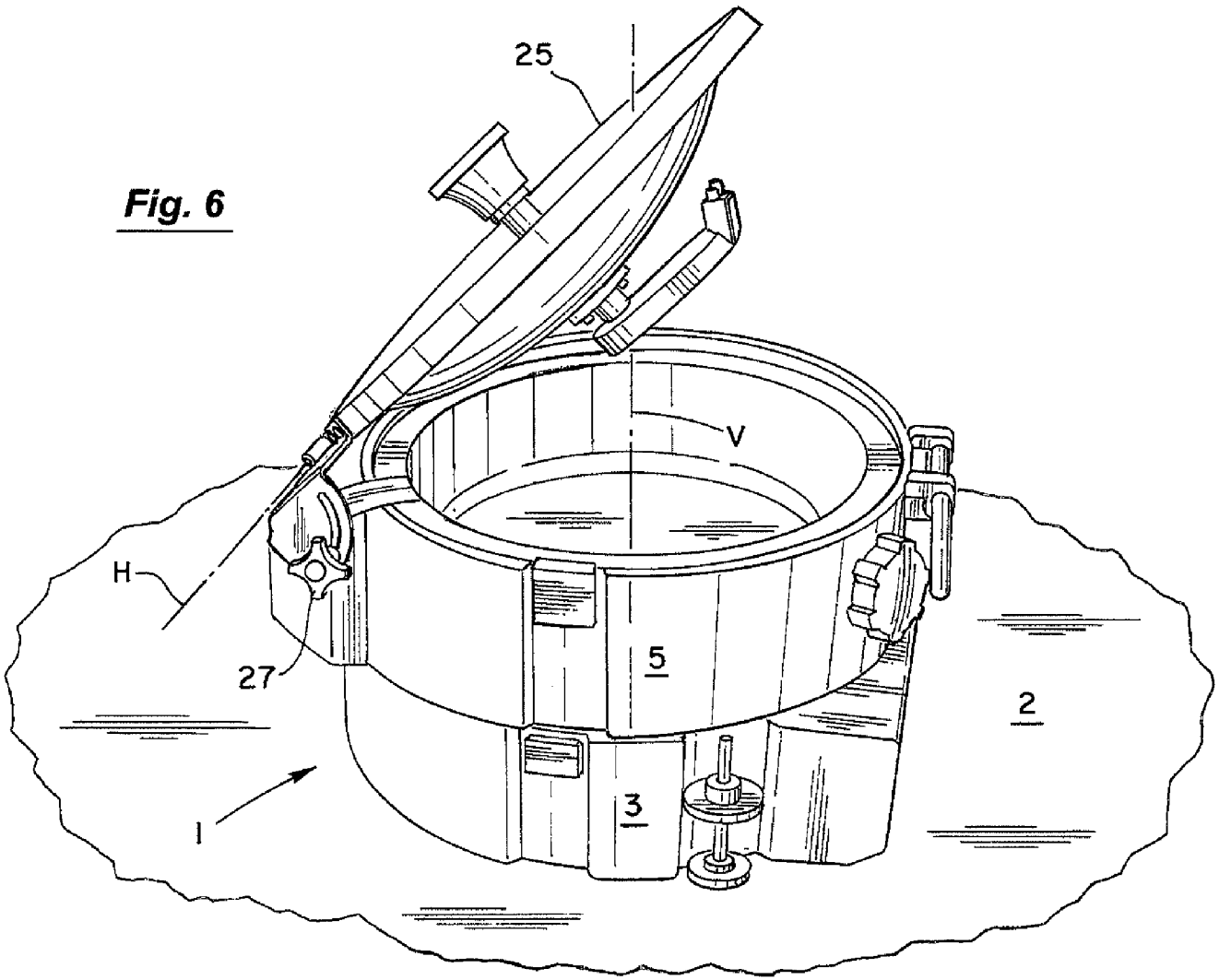
Figure 7:
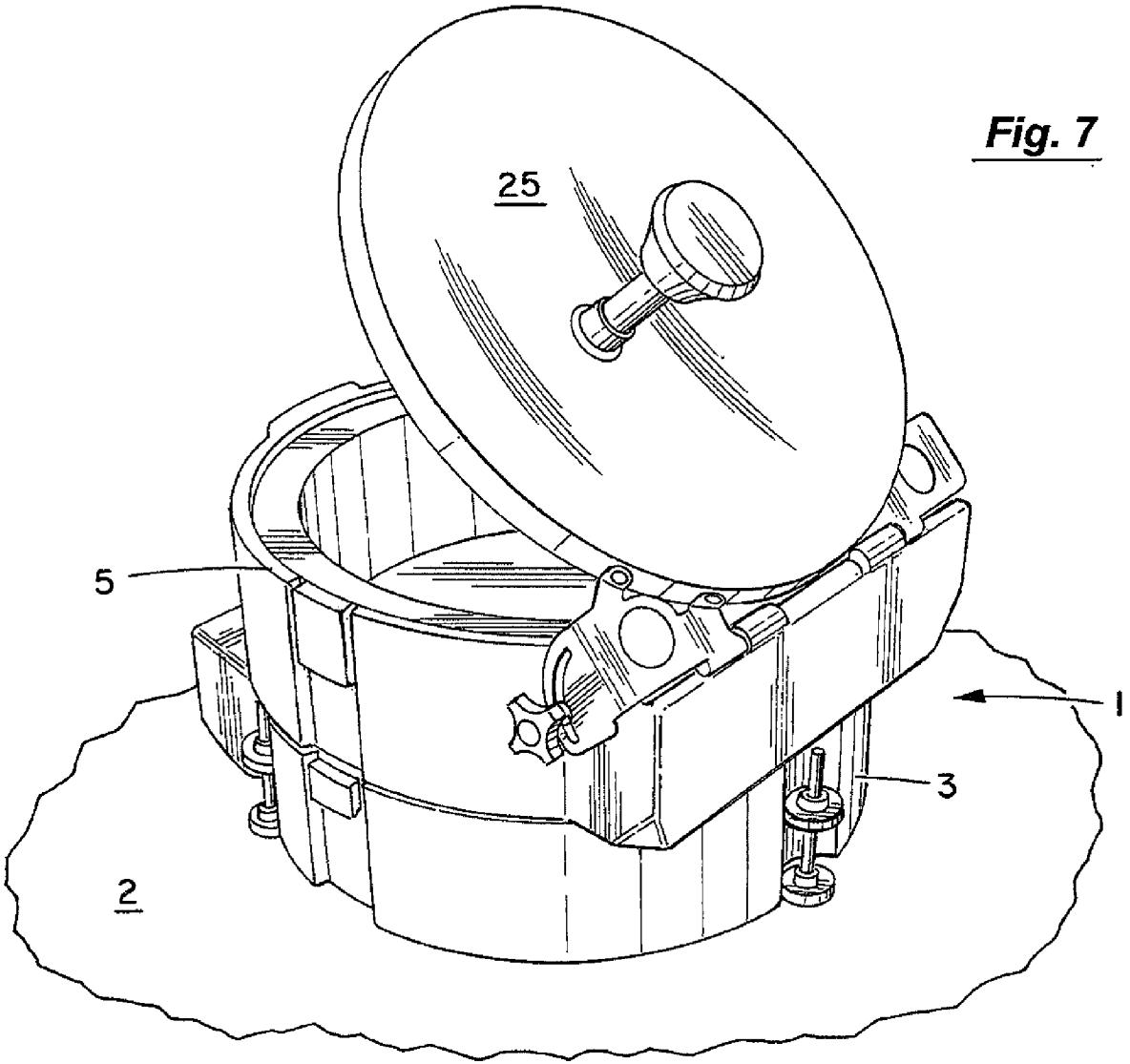

To deploy the portable satellite antenna system 1, the substantially hollow lid portion 5 is preferably first filled with a flowable ballast material (e.g., a gallon of water or sand) to add weight (e.g., 8 pounds) to it. This can be easily and conveniently done by removing the fill cap 15 (FIG. 12) with the secured system 1 in the upright position of FIG. 12. With the fill cap 15 back in place, the system 1 can be placed flat on its base portion 3 as in FIGS. 3 and 11 and the latch mechanisms 7 released. With the latch mechanisms 7 released, the lid portion 5 can be removed from the base portion 3 and inverted (FIG. 4) and then placed atop the base portion 3 (FIG. 5). In the position of FIG. 5 with the base portion 3 on a relatively flat surface 2, the base and lid portions 3,5 can be further leveled if desired. This can be done for example by using the bubble level 17 (see FIG. 10) and screwing the feet 19 (FIG. 5) in and out or by adjusting the tripod legs 21 in the arrangement of FIGS. 8-10. The base portion 3 could also be removably secured as for example by the fixed, rubber feet 19' of FIGS. 10-11 to a separate tripod arrangement having its own central platform and leveling aids if desired.

Figure 15:
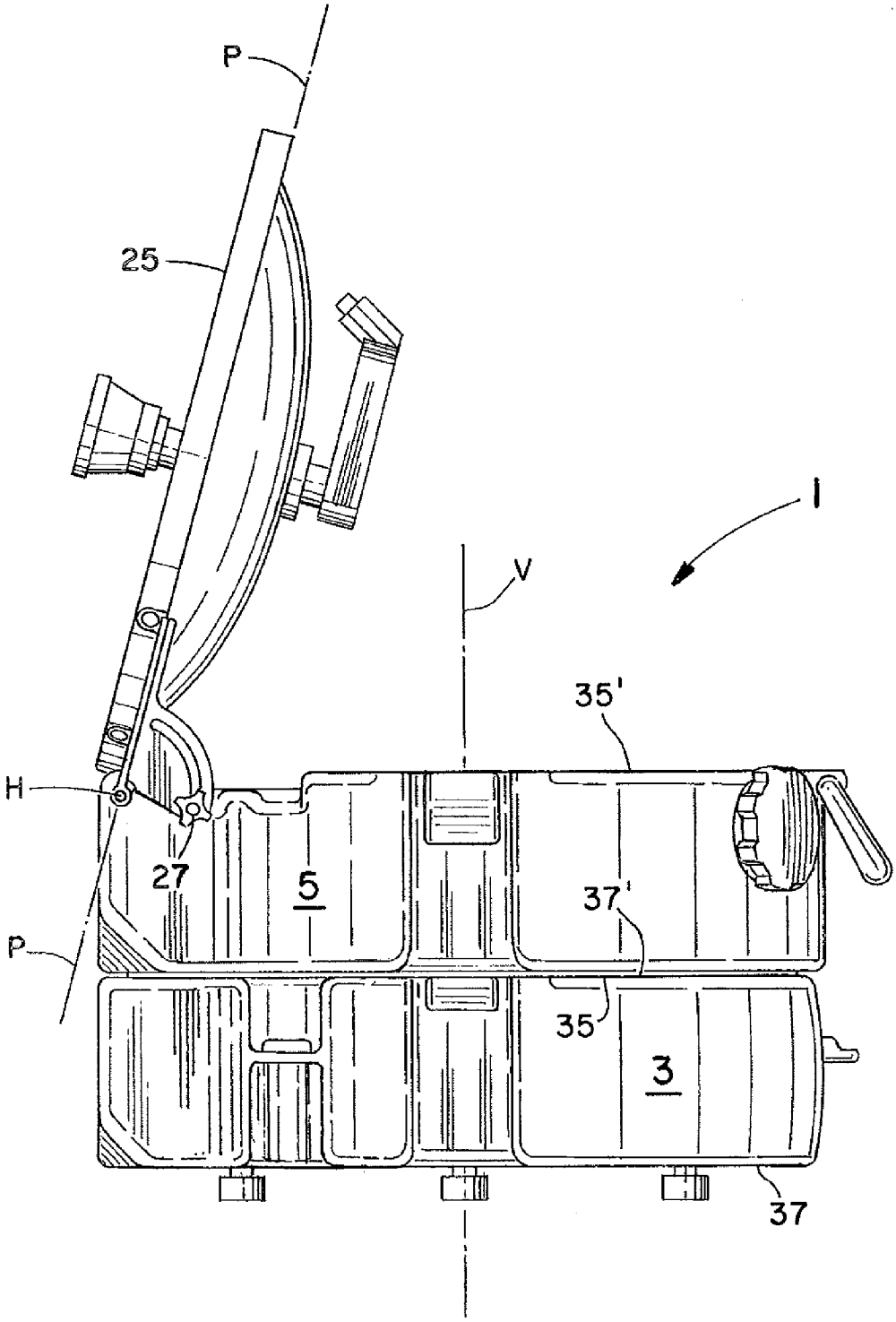
FIG. 15 is a view of the system with the satellite dish antenna in an elevated position similar to that of FIG. 6.
Figure 16:
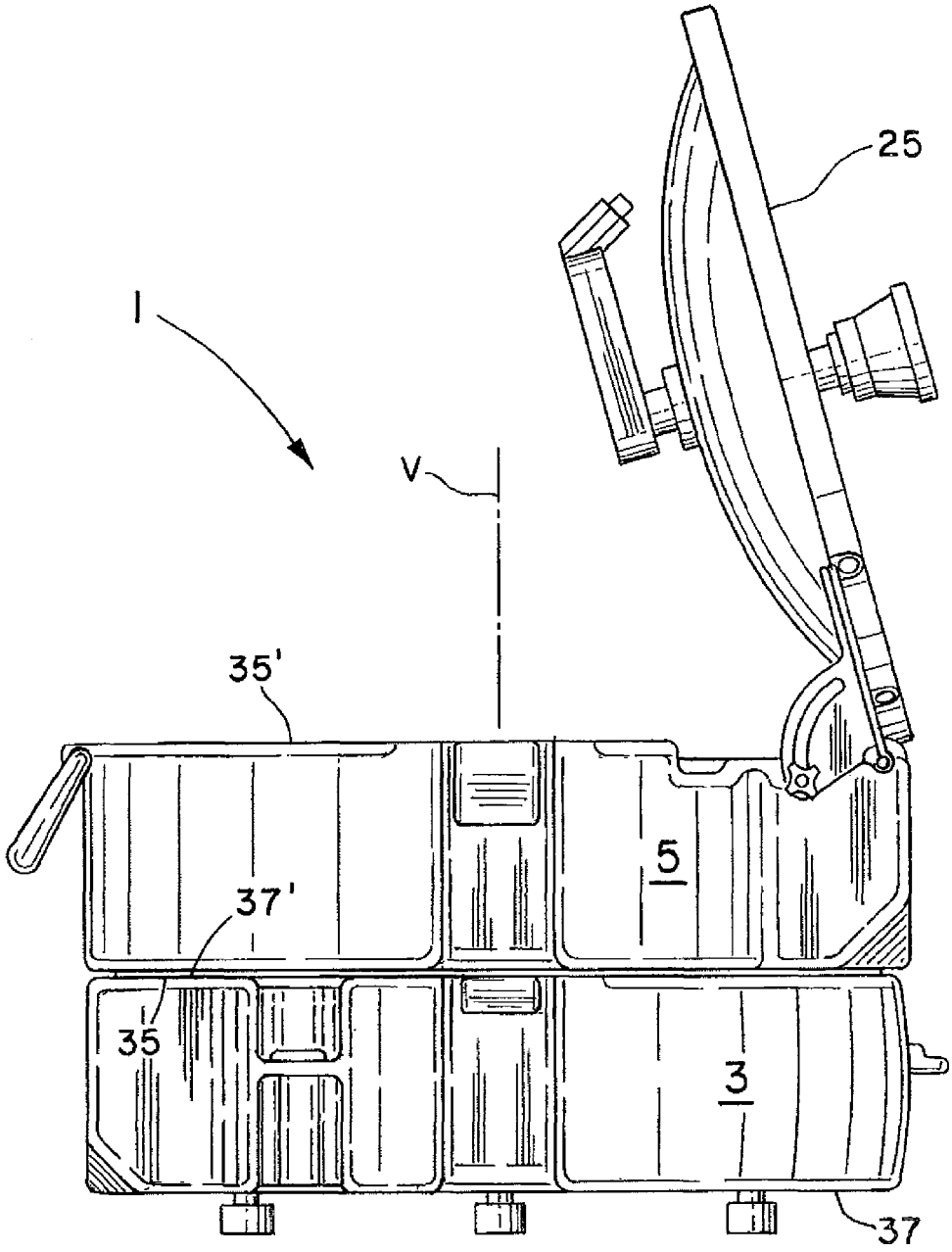
FIG. 16 shows the system in a position similar to that of FIG. 7.
Figure 17:
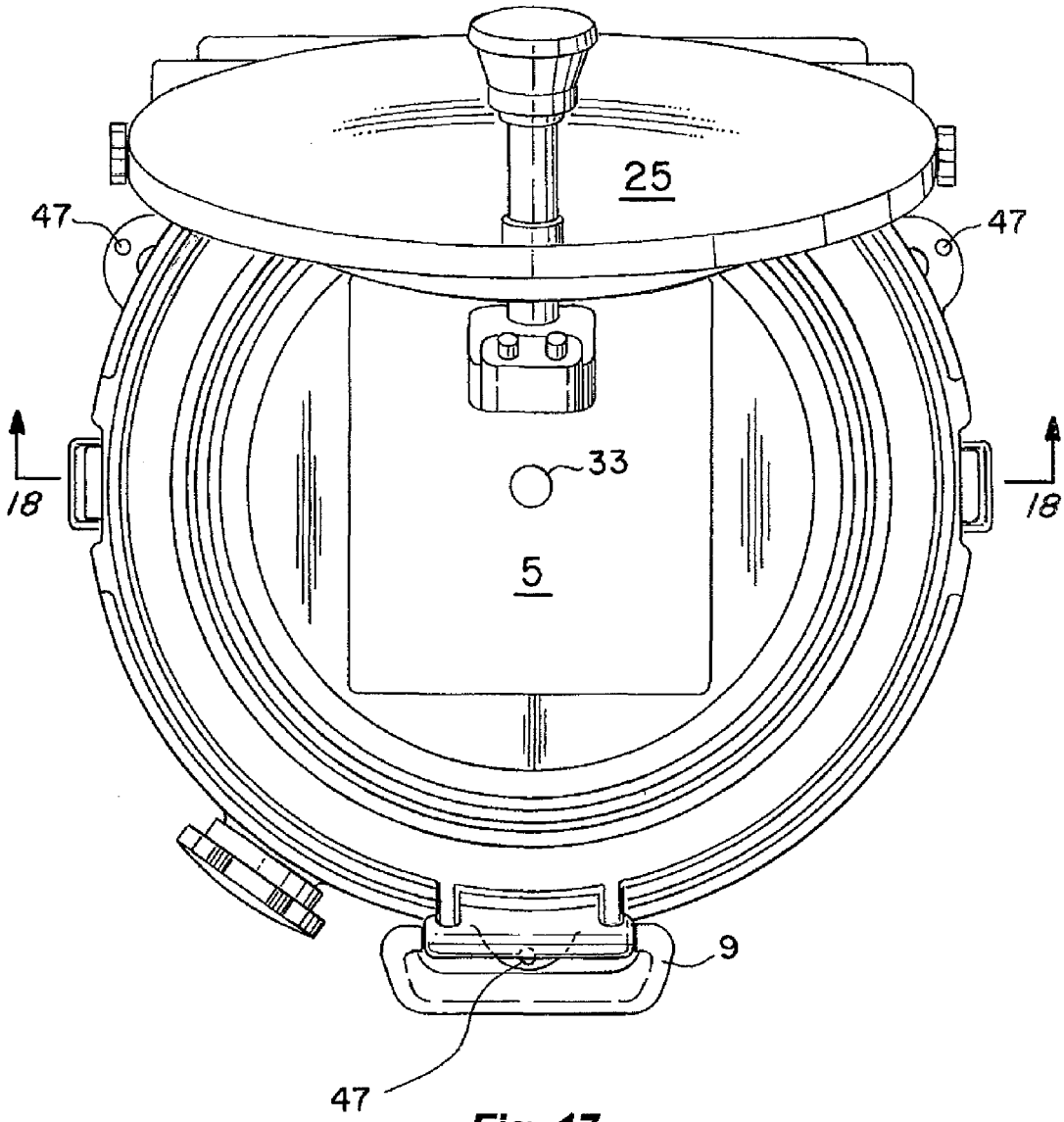
FIG. 17 is a plan view of the system in the position of FIG. 16.
Figure 18:
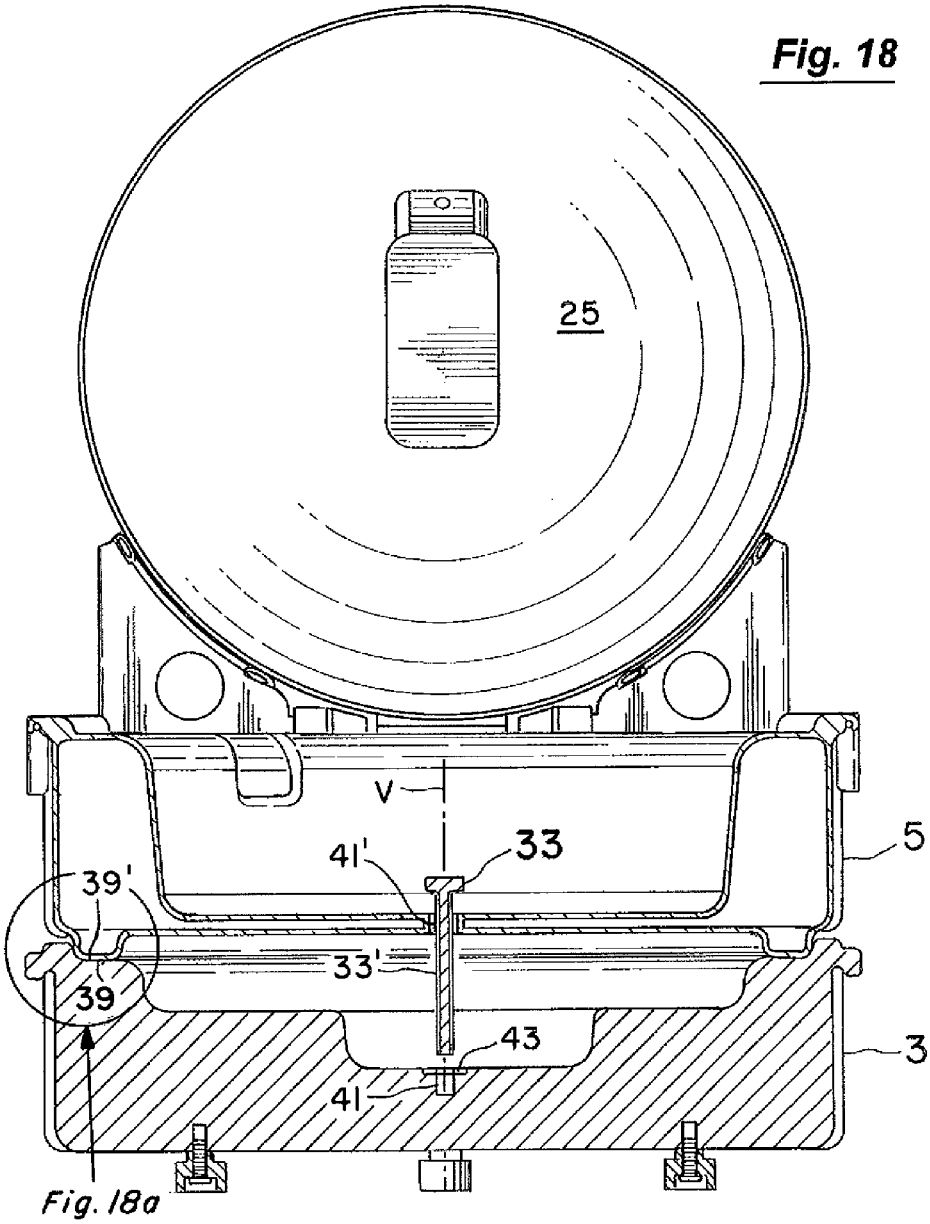
FIG. 18 is a partial cross-sectional view of the system taken along line 18-18 of FIG. 17.
Figure 19:
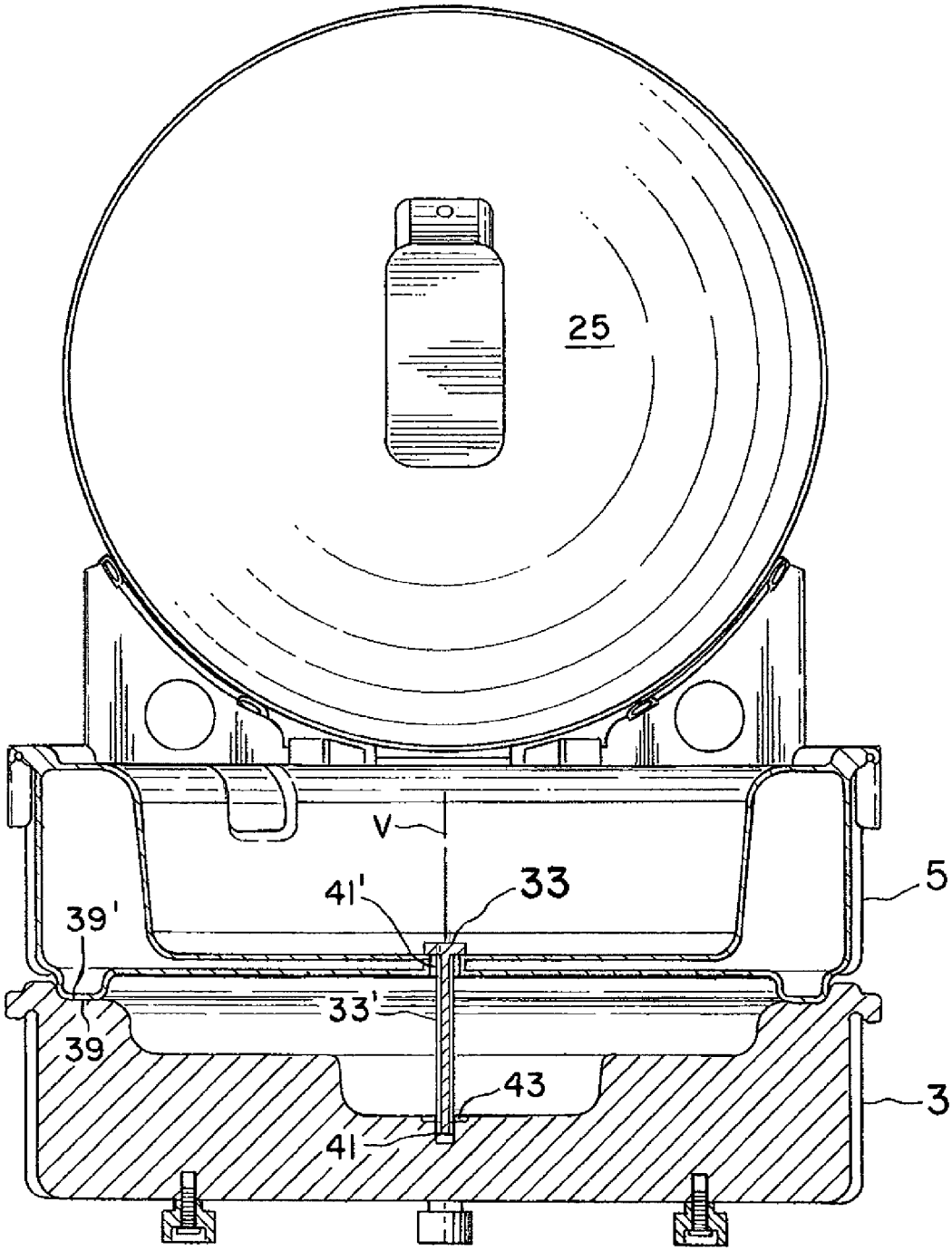
FIG. 19 is a view similar to FIG. 18 but with the locking mechanism in its lowered, locking position.

In any event and once the desired leveling is accomplished (e.g., on the surface 2 of FIG. 5), the dish antenna 25 can be elevated by loosening the thumb screws 27 on both sides of the lid portion 5 and pivoting the dish antenna 25 (FIGS. 6 and 15) about the substantially horizontal axis H to the desired elevation. The axis H in this regard is preferably spaced from the axis V and substantially perpendicular thereto. In the desired elevation, the dish antenna 25 extends substantially in a plane P (FIG. 15) at angle substantially between zero and 90 degrees to a horizontal plane containing the axis H. With the thumb screws 27 of FIGS. 6 and 15 re-tightened, the lid portion 5 can be rotated (FIGS. 7 and 16) relative to the base portion 3 about the vertical axis V to the desired azimuth position. Once in the desired azimuth position of FIG. 16 and as explained in more detail below, the lid portion 5 can be locked in place by tightening the central locking bolt 33 of FIGS. 17-18. In doing so, the lid portion 5 and base portion 3 are firmly drawn together into a fixed position relative to each other (FIG. 19).

Figure 20:
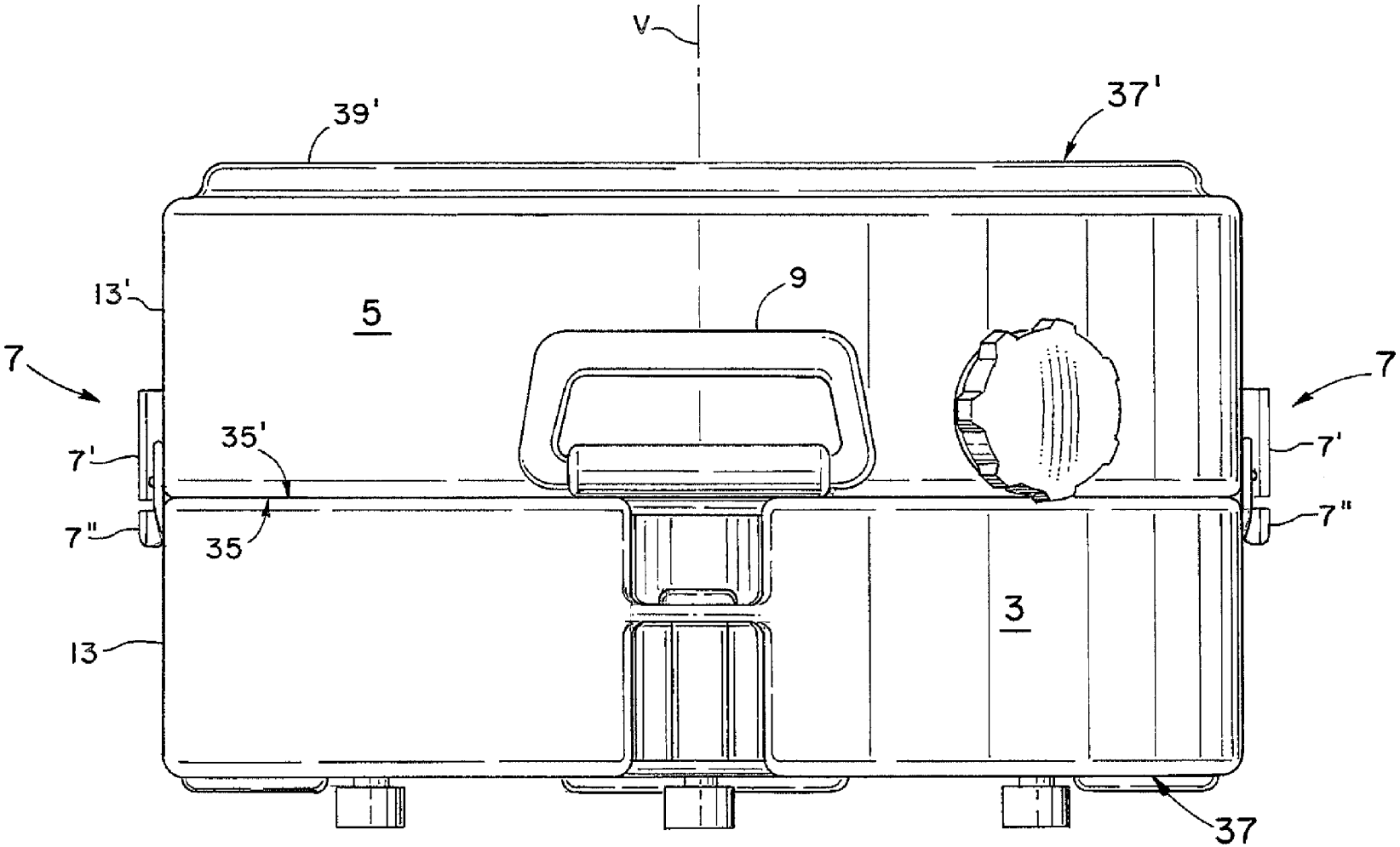
FIG. 20 shows the base and lid portions of the system in the carrying configuration.
Figure 21:
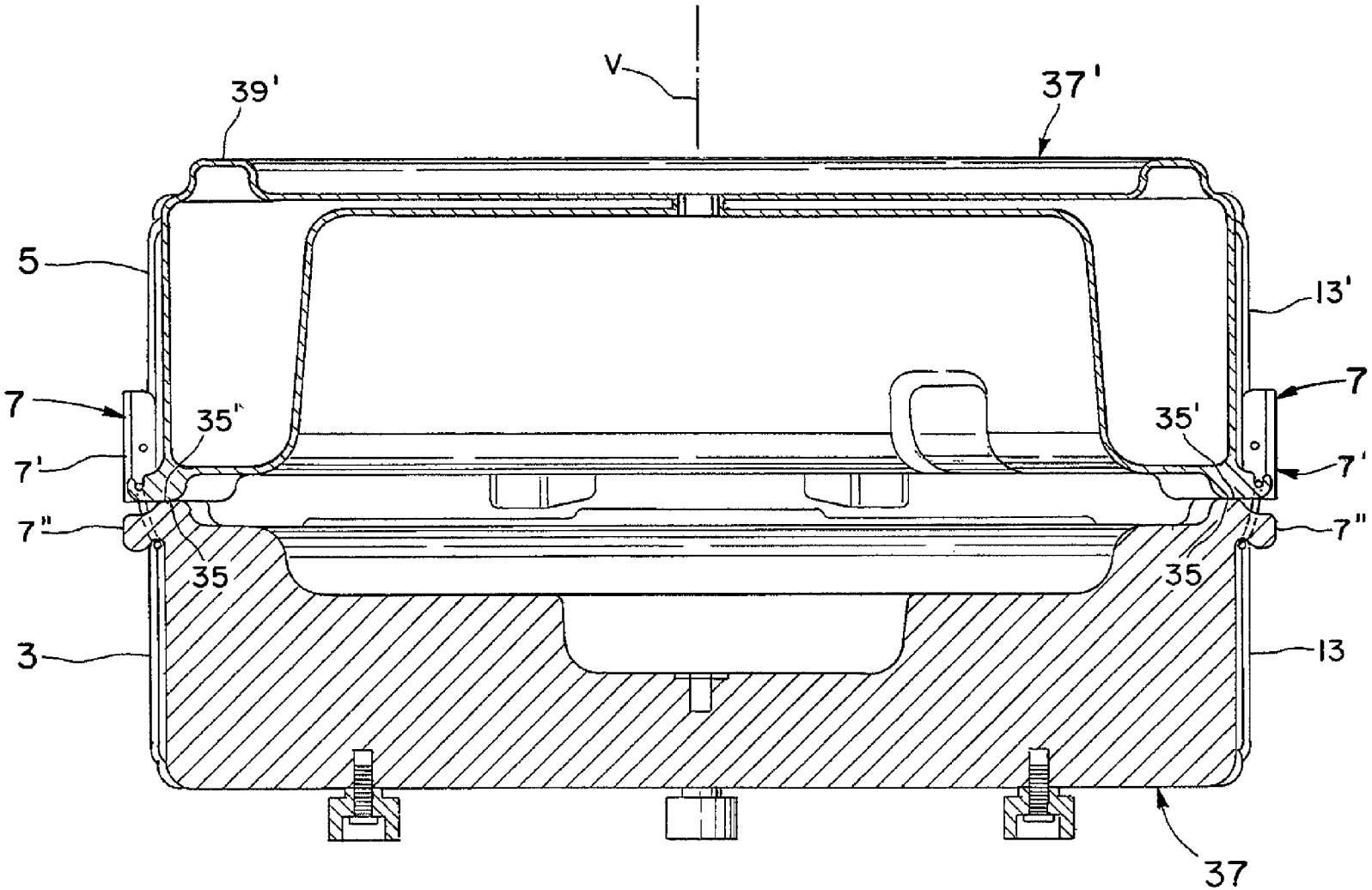
FIG. 21 is a partial cross-sectional view of FIG. 20.

More specifically and as best seen in FIG. 20, the base and lid portions 3,5 have respective interior and exterior sides 35,37 and 35',37'. In the carrying position of FIG. 20, the interior sides 35,35' are facing and abutting one another (see also FIG. 21) and are securely held in place by the latching mechanisms 7. The latching mechanisms 7 as shown in FIGS. 20 and 21 have segments 7',7" on the respective peripheral surfaces 13,13' of the base and lid portions 3,5. The base and lid portions 3,5 are then secured by the latching mechanisms 7 in a predetermined, fixed position relative to each other about the vertical axis V with the interior sides 35,35' facing and abutting one another. In contrast and in the deployed or operating position with the lid portion 5 inverted and placed on the base portion 3 as in FIG. 15, the exterior side 37' of the lid portion 5 is facing and abutting the interior side 35 of the base portion 3.

Figure 3:
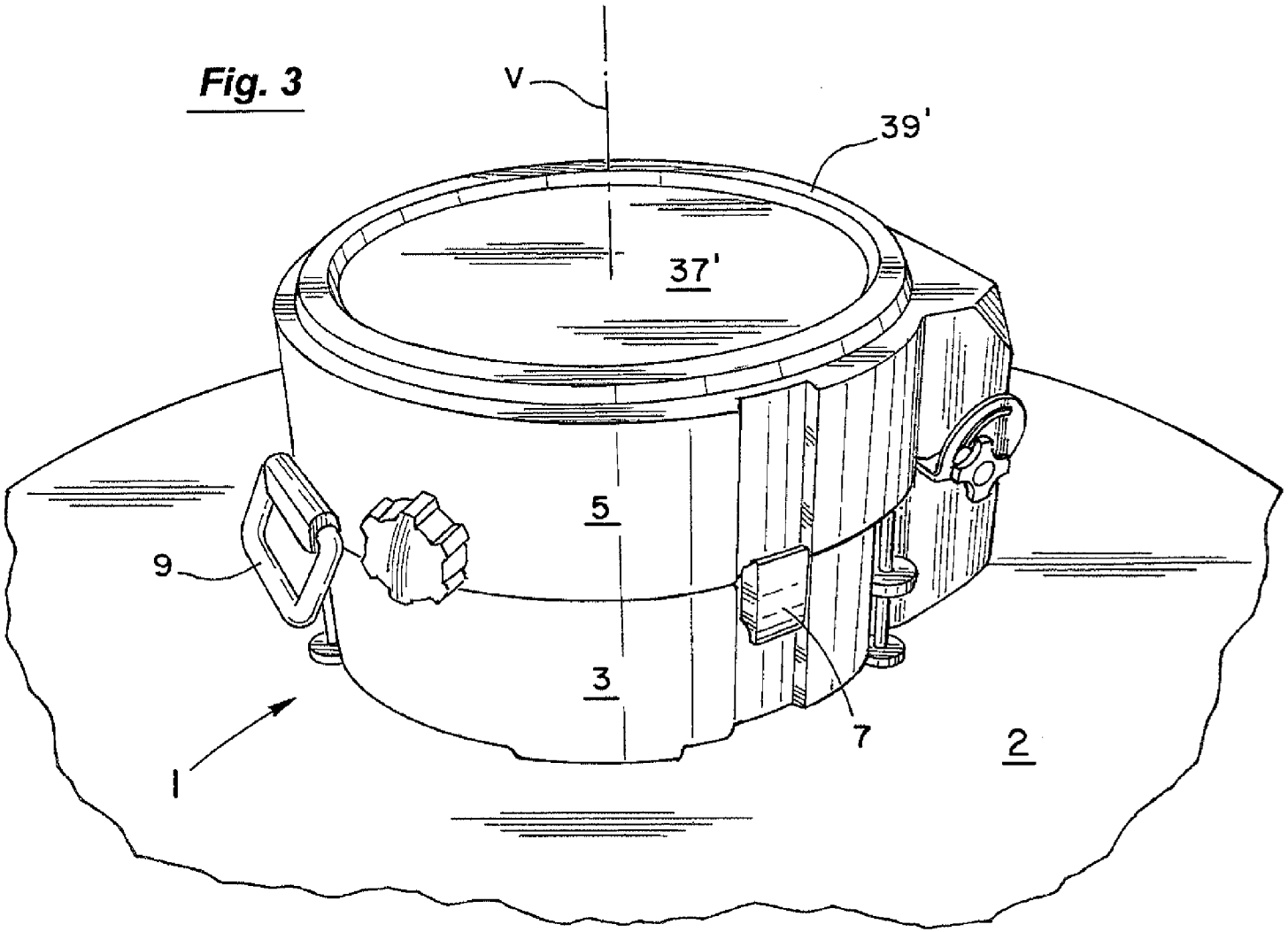
Figure 18A:
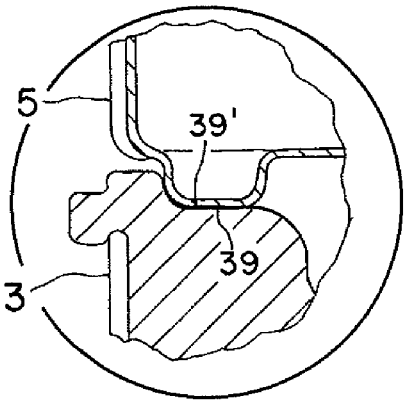
FIG. 18*a* is an enlarged view of the encircled area of FIG. 18.

The exterior side 37' of the lid portion 5 in this regard has a bearing surface 39' spaced from and extending substantially about the vertical axis V as perhaps best seen in FIG. 3. Similarly, the interior side 37 of the base portion 3 has a mating bearing surface 39 (FIG. 4). In the position of FIG. 18 with the lid portion 5 inverted atop the base portion 5, the respective concave and convex bearing surfaces 39,39' then abut and mate with one another (see also the enlarged view of FIG. 18*a*). In this manner, the lid portion 5 can thus be manually and slidably moved or rotated about the vertical axis V relative to the base portion 3 (e.g., from the position of FIG. 15 to that of FIG. 16). Once in the desired rotational or azimuth position (e.g., FIG. 16) and as discussed above, the threaded locking bolt 33 can be tightened (FIGS. 18-19) to draw the base and lid portions 3,5 firmly together into a fixed position relative to each other. The slots 41,41' in this regard receive the threaded shaft 33' of the bolt member 33 with the lower slot 41 preferably provided with a threaded insert 43 as shown in FIGS. 18 and 19. The shaft 33' is preferably centered as also shown in FIGS. 18-19 to extend along an axis substantially collinear with the vertical axis V.

Figure 22:
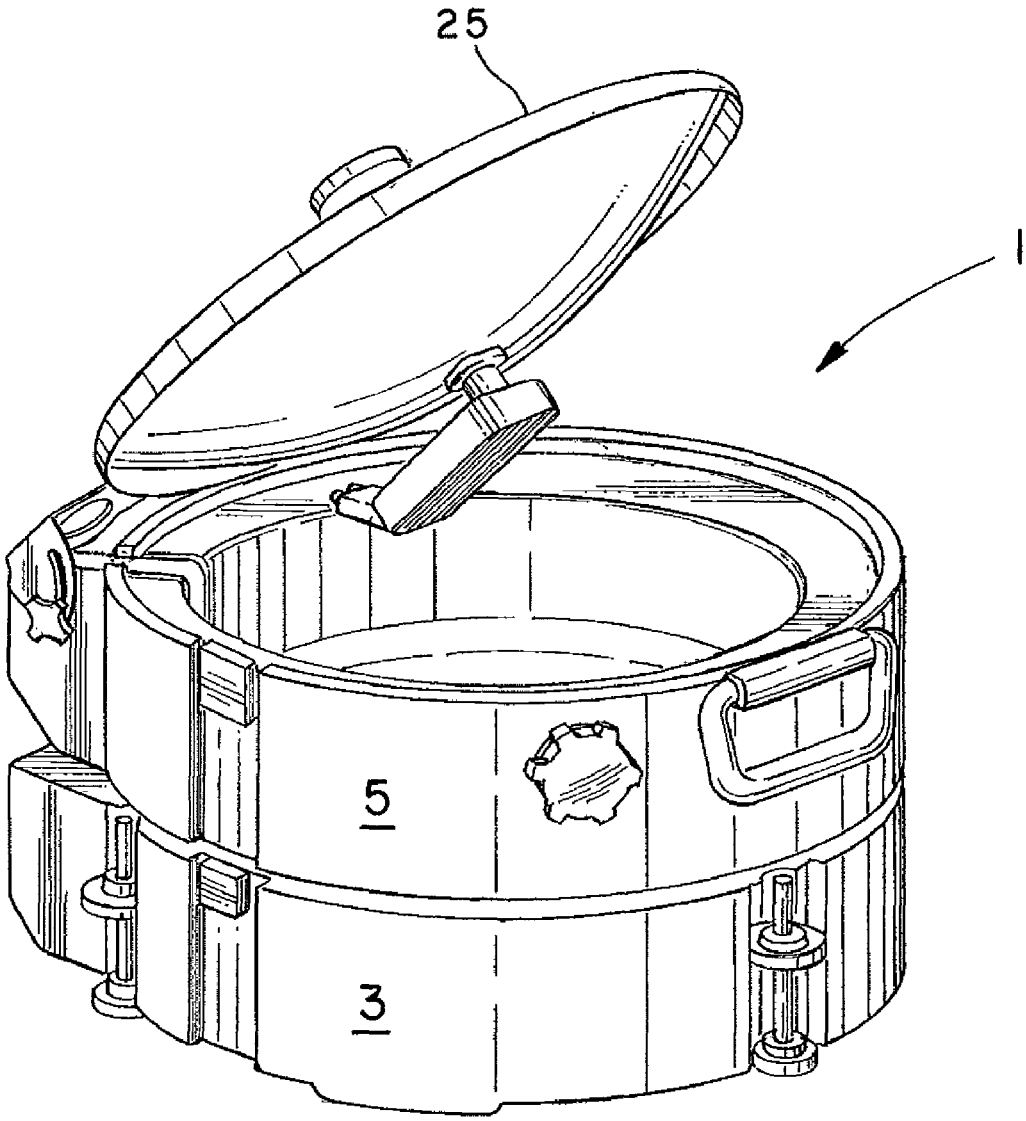
FIG. 22 is a perspective view of the system in an operating position with the satellite dish antenna elevated.

The base and lid portions 3,5 are preferably substantially the same size and shape (e.g., cylindrical with each about 15 inches across and 4.5 inches deep). The base and lid portions are also preferably molded of lightweight plastic (see FIG. 22) to save weight and give the system 1 a clean and attractive look. Combined together, the plastic base and lid portions 3,5 weigh only about ten pounds with the hollow lid portion 5 empty of any ballast material. In the carrying position of FIG. 1, the compact and portable system 1 can then be easily handled and placed wherever desired. The cylindrical shapes of the base and lid portions 3,5 also make it easy and convenient to manipulate them to abut the respective ends 35, 35', and 37' of the cylindrical shapes in the carrying and operating positions. The system 1 as discussed above can be set on a relatively flat surface such as 2 in FIGS. 1-7 or supported on a tripod arrangement such as 4 in FIGS. 8-10 secured to the exterior side 37 of the base portion 3. A separate tripod arrangement with its own central platform could also be used with the base portion 3 removably attached thereto adjacent the exterior side 37. Additionally, the system 1 can be provided with tent stakes such as 45 in FIG. 4 that are storable in the base portion 3. In use, the stakes 45 can be hooked through loops or holes (e.g., 47 in FIG. 17) about the peripheral surface of the base portion 3 and driven into the ground if no hard surface or tripod is available.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims. In particular, it is noted that the word substantially is utilized herein to represent the inherent degree of uncertainty that may be attributed to any quantitative comparison, value, measurement or other representation. This term is also utilized herein to represent the degree by which a quantitative representation may vary from a stated reference without resulting in a change in the basic function of the subject matter involved.

I claim:

1. A portable satellite dish antenna system having a base portion and a lid portion, said base and lid portions respectively having interior and exterior sides extending about a first axis, said lid portion being selectively positionable relative to said base portion in a first position with the interior side of the lid portion facing and abutting the interior side of the base portion and in an inverted, second position with the exterior side of said lid portion facing and abutting the interior side of the base portion, said system having a satellite dish antenna mounted to said lid portion adjacent the interior side thereof for pivotal movement relative to the interior side of the lid portion about a second axis spaced from and substantially perpendicular to said first axis between at least a retracted position and a deployed position, said satellite dish antenna in said retracted position extending substantially perpendicular to said first axis adjacent the interior side of said lid portion and in said deployed position extending substantially in a plane at an angle substantially between zero and 90 degrees relative to a horizontal plane containing said second axis, said interior side of said base portion and said exterior side of said lid portion having mating bearing surfaces respectively extending substantial about said first axis wherein the bearing surface of said lid portion in said inverted, second position abuts and mates with the bearing surface of said base portion, said lid portion being manually and slidably rotatable about said first axis relative to said base portion with said bearing surfaces mating and abutting each other.

2. The system of claim 1 further including a locking mechanism selectively securing the lid portion and base portion together in a fixed position relative to each other with the lid portion in said inverted, second position relative to said base portion and said satellite dish antenna on the lid portion in said deployed position.

3. The system of claim 2 wherein said locking mechanism includes a member with a threaded shaft receivable in slots in said lid portion and base portion to draw said lid portion and base portion together into said fixed position.

4. The system of claim 3 wherein the threaded shaft of said member extends along an axis substantially collinear with said first axis.

5. The system of claim 1 further including at least one latching mechanism for selectively securing the lid portion with said satellite dish antenna in said retracted position to said base portion in said first position with the interior sides of said lid portion and base portion facing and abutting one another.

6. The system of claim 5 wherein the latching mechanism includes segments on the base portion and lid portion and said latching mechanism secures said base portion and lid portion together in a predetermined, fixed position about said first axis relative to each other.

7. The system of claim 6 further including at least one handle for manually carrying the base portion and lid portion with the latch mechanism securing said base portion and lid portion in said predetermined, fixed position.

8. The system of claim 5 further including a handle for manually carrying the base portion and lid portion with the latch mechanism securing said base portion and lid portion to each other in said predetermined, fixed position.

9. The system of claim 5 wherein said base portion and lid portion have peripheral surfaces respectively extending about said first axis with each peripheral surface having a flat section wherein said flat section are aligned adjacent one another substantially in a common plane with the latching mechanism securing said base portion and lid portion to each other.

10. The system of claim 9 further including a handle for manually carrying the base portion and lid portion with the latching mechanism securing the base portion and lid portion together, said handle being mounted to at least one of the peripheral surfaces of said base portion and lid portion substantially opposite the aligned flat sections of said base portion and lid portion about said first axis.

11. The system of claim 1 wherein said base portion and lid portion are substantially the same size and shape.

12. The system of claim 11 wherein said base portion and lid portion are substantially cylindrical in shape.

13. The system of claim 12 wherein said cylindrical base portion and lid portion have respective ends extending about said first axis and said base portion and lid portion respectively abut one another in said first and second positions substantially at and about the respective ends of said cylindrical shapes.

14. The system of claim 1 further including a tripod arrangement having three legs and being securable to the exterior side of the base portion.

15. The system of claim 1 wherein the mating bearing surfaces are respectively substantially concave and convex surfaces spaced from and extending substantially about said first axis.

16. The system of claim 1 wherein said lid portion is substantially hollow to selectively receive flowable ballast material therein.

17. A method for configuring a portable satellite dish antenna system in at least first and second positions, said method including the steps of:

(a) providing a base portion and lid portion having respective interior and exterior sides extending about a first axis and having respective bearing surfaces respectively extending substantially about said first axis in the exterior side of the lid portion and the interior side of the base portion, (b) mounting a satellite dish antenna to said lid portion adjacent the interior side thereof for pivotal movement relative to the interior side about a second axis spaced from and substantially perpendicular to said first axis between at least a retracted position and a deployed position with the satellite dish antenna in said retracted position extending substantially perpendicular to said first axis adjacent the interior side of said lid portion and in said deployed position extending substantially in a plane at an angle substantially between zero and 90 degrees relative to a horizontal plane containing the second axis, (c) positioning the satellite dish antenna in said retracted position and said base portion and lid portion in a first position with the respective interior sides thereof facing and abutting one another, (d) inverting said lid portion in a second position with the exterior side thereof facing and abutting the interior side of the base portion and said respective bearing surfaces abutting and mating with each other, (e) elevating the satellite dish antenna about said second axis to a deployed position, and (f) rotating said lid portion relative to said base portion about said first axis.

18. The method of claim 17 further including the step of (g) locking said lid portion and base portion together in a fixed position relative to each other.

19. The method of claim 17 further including the steps of (g) lowering the elevated satellite dish antenna to the retracted position and (h) placing the lid portion and said base portion in said first position with the respective interior sides thereof facing and abutting one another.

20. The method of claim 19 further including the step of latching the base portion and lid portion to each other in the position of step (h).

21. The method of claim 20 further including the step of providing at least one of said lid portion and base portion with a carrying handle.

22. The method of claim 17 further including the limitations of making the lid portion substantially hollow and selectively adding flowable ballast material therein.

* * * * *